US009999820B2

(12) United States Patent
Steenberg

(10) Patent No.: US 9,999,820 B2
(45) Date of Patent: Jun. 19, 2018

(54) SWINGING DEVICE

(71) Applicant: The Twitch Trainer, LLC, Rochester, NY (US)

(72) Inventor: Ryan Steenberg, Webster, NY (US)

(73) Assignee: The Twitch Trainer, LLC, Rochester, NY (US)

( * ) Notice: Subject to any disclaimer, the term of this patent is extended or adjusted under 35 U.S.C. 154(b) by 39 days.

(21) Appl. No.: 15/052,433

(22) Filed: Feb. 24, 2016

(65) Prior Publication Data

US 2017/0239549 A1 Aug. 24, 2017

(51) Int. Cl.
*A63B 69/36* (2006.01)

(52) U.S. Cl.
CPC ..... *A63B 69/36* (2013.01); *A63B 2208/0204* (2013.01)

(58) Field of Classification Search
USPC ..... 473/219, 226, 227, 229, 256, 257, 266, 473/269, 409
See application file for complete search history.

(56) References Cited

U.S. PATENT DOCUMENTS 3,229,980 A * 1/1966 Silberman ..... A63B 69/3632 473/232
4,343,473 A * 8/1982 Laursen ..... A63B 69/3632 473/256
4,878,673 A 11/1989 Pollard
4,932,661 A 6/1990 Choi
4,982,963 A 1/1991 Fazio et al.
5,058,883 A * 10/1991 Dybvik ..... A63B 67/10 473/579
5,207,625 A * 5/1993 White ..... A63B 21/0088 473/228
5,316,306 A 5/1994 Cody
5,807,183 A * 9/1998 Benson ..... A63B 15/005 473/206
5,865,686 A 2/1999 MacGregor
7,326,124 B1 * 2/2008 Fairbanks ..... A63B 69/3632 473/256
7,509,842 B2 3/2009 Kostuj
7,509,843 B2 3/2009 Kostuj
7,785,211 B2 8/2010 Hackenberg
8,172,696 B2 5/2012 Lum
8,540,584 B1 9/2013 Sorenson
9,199,152 B2 * 12/2015 Phillips ..... A63B 69/3632
2007/0129159 A1 * 6/2007 Koncelik, Jr. ..... A63B 69/36 473/226
2010/0022319 A1 * 1/2010 Scaperotti ..... A63B 21/0088 473/228

* cited by examiner

*Primary Examiner* — Nini Legesse
(74) *Attorney, Agent, or Firm* — Brian B. Shaw, Esq.; Alfred Y. Chu, Esq.; Harter Secrest & Emery LLP

(57) ABSTRACT

The present disclosure provides a method and apparatus for training. The apparatus includes a grip configured for engaging a user hand, and a grip extension movably coupled to the grip between a retracted position and an extended position. The apparatus further includes a flexible shaft coupled to at least one of the grip and the grip extension and extending a substantially fixed length, and a fan connected to the flexible shaft.

31 Claims, 6 Drawing Sheets

SWINGING DEVICE

BACKGROUND OF THE DISCLOSURE

Field of the Disclosure

Embodiments of the present disclosure relate to a method and apparatus for training. The present disclosure relates more particularly to a method and apparatus for swing training.

Description of Related Art

Golf stroke mechanics is the means by which golfers make decisions (selecting clubs, selecting shots) and execute them (making shots) in the sport of golf. For all golfers, the mechanics include a pre-stroke component wherein the golfer chooses a club, their stance, and the actual stroke. The stroke itself is a complex motion. A successful and consistent golf swing (stroke) requires precise timing and mechanics, from the grip and position of one's fingers, to the position and movement of the feet. At any moment of the swing, whether back swing, down swing, or upswing many things can result in a miss hit.

Golf instruction is meant to train golfers to improve their golf swing to play better golf through improved awareness of their swing and the effects the body, the club, and the golf ball.

Golf instruction can be wide ranging, but many great modern day instructors are able to diagnose swing frustrations accurately and present a clear fix that encourages the golfer in the discovery of lasting repeatability from the specific ailment that "plagued" them from a sound repeatable swing to play a golf course successfully (varying terms of success as a golfer).

Beginning players can start lesson in several ways, but most do so in either a group or individual setting, covering the five primary skills of golf of a golf swing. Golf is an asymmetrical exercise that can break body balances, requiring also adequate exercises to keep the balance in muscles. Experienced recreational players often return for instruction, either to fix a specific problem they are encountering or to improve their game. Reconstruction of a golf swing to reach a high level of play often involves a series of lessons over an extended period of time.

BRIEF SUMMARY OF THE DISCLOSURE

In view of the foregoing, it is an object of the present disclosure to provide a method and apparatus for training.

A first exemplary embodiment of the present disclosure provides a method for training. The method includes providing an apparatus, the apparatus including at least a handle, the handle comprising a rigid cylindrical shaft defining a hollow center, and an extending member, the extending member slidably coupled to the handle operable to slide to and from an unextended position wherein a portion of the extending member is within the hollow center and an extended position wherein the portion of the extending member is not within the hollow center. The apparatus further includes a fastener, the fastener moveably coupled to the handle and the extending member operable to selectively fix a position of the extending member relative to the handle, and a flexible cord, the flexible cord coupled to the extending member. The apparatus further includes a collapsible fan, the collapsible fan coupled to the flexible cord, the collapsible fan moveable between a collapsed configuration and an expanded configuration.

A second exemplary embodiment of the present disclosure provides an apparatus for training. The apparatus includes a handle, the handle comprising a rigid cylindrical shaft defining a hollow center, and an extending member, the extending member slidably coupled to the handle operable to slide to and from an unextended position wherein a portion of the extending member is within the hollow center and an extended position wherein the portion of the extending member is not within the hollow center. The apparatus further includes a fastener, the fastener moveably coupled to the handle and the extending member operable to (i) fix a position of the extending member relative to the handle, and (ii) allow movement of the extending member relative to the handle, and a flexible cord, the flexible cord coupled to the extending member. The apparatus also includes a collapsible fan, the collapsible fan coupled to the flexible cord, the collapsible fan operable to collapse to and from an expanded configuration wherein the expanded configuration has a greater resistance to flow than a collapsed configuration.

A third exemplary embodiment of the present disclosure provides a method of manufacturing. The method includes forming a handle, the handle comprising a rigid cylindrical shaft defining a hollow center, and attaching an extending member, the extending member slidably coupled to the handle operable to slide to and from an unextended position wherein the extending member is within the hollow center and an extended position wherein the extending member is not within the hollow center. The method further includes attaching a fastener, the fastener moveably coupled to the handle and the extending member operable to fix a position of the extending member relative to the handle and allow movement of the extending member relative to the handle, and attaching a flexible cord, the flexible cord coupled to the extending member. The method further includes attaching a collapsible fan, the collapsible fan coupled to the flexible cord, the collapsible fan operable to collapse to and from an expanded configuration and a collapsed configuration.

A fourth exemplary embodiment of the present disclosure provides an apparatus for training. The apparatus includes a grip configured for engaging a user hand, and a flexible shaft coupled to the grip and extending from the grip a substantially fixed length. The apparatus further includes a collapsible fan connected to the flexible shaft, the collapsible fan moveable between a collapsed position and an expanded position, wherein the expanded position of the fan provides a greater resistance to movement than the collapsed position.

A fifth exemplary embodiment of the present disclosure provides an apparatus for training. The apparatus includes a grip configured for engaging a user hand, and a grip extension movably coupled to the grip between a retracted position and an extended position. The apparatus further includes a flexible shaft coupled to at least one of the grip and the grip extension and extending a substantially fixed length, and a fan connected to the flexible shaft The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE DISCLOSURE

A successful golfer typically has a golf swing that is repeatedly technically sound. However, driving distance is both a function of a technically sound golf swing and fast golf club head speed. The average golfer can spend countless hours swinging a golf club to perfect both of these attributes without ever gaining much improvement. Accordingly, there is a need for a device that can help a golfer develop the muscle memory and strength to improve their golf game.

Embodiments of the present disclosure provide a golf training device to aid a user in developing proper golf swing. Embodiments of the present disclosure also provides a golf training device meant to develop a golfer's strength. Embodiments of the present disclosure provide a golf training device that is adjustable to simulate different lengths of golf clubs. Embodiments of the present disclosure provide a golf training device that has multiple configurations that provide varying levels of user resistance during use. Embodiments of the present disclosure provide a golf training device that enables a user to train their fast and slow twitch muscles such that head speed of the golf club is maximized at the point of contact of the golf ball.

Figure 1:
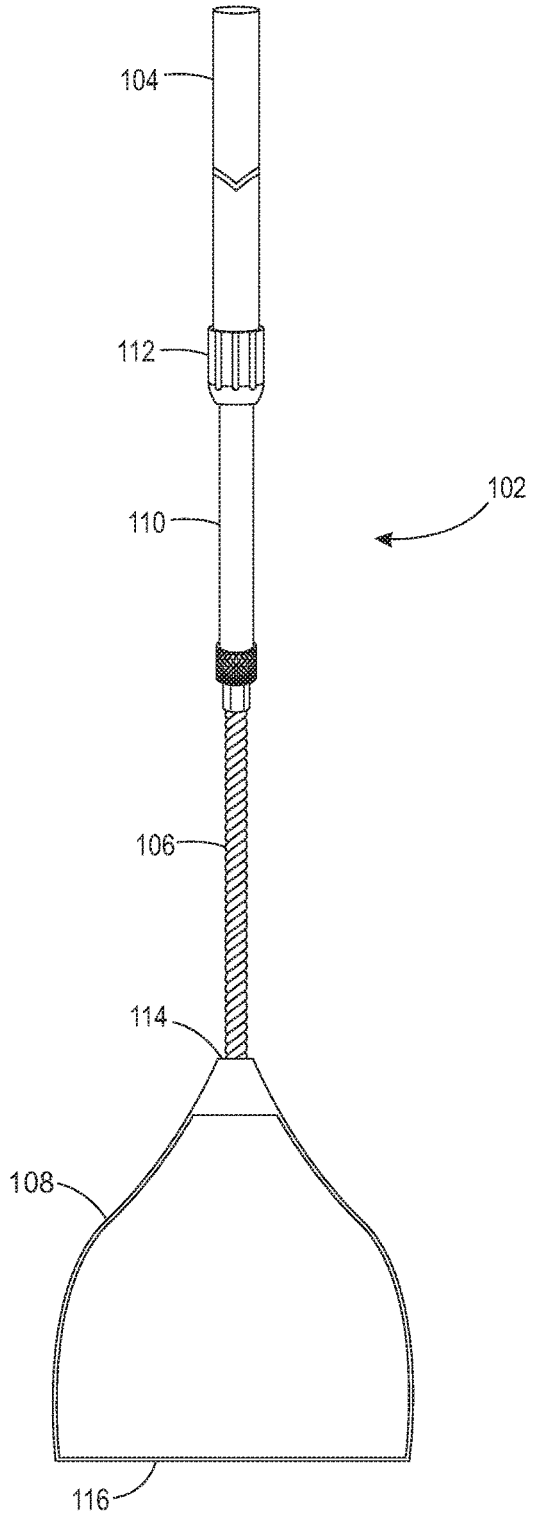
FIG. 1 is a front view of an exemplary device suitable for use in practicing exemplary embodiments of this disclosure.

Referring to FIG. 1, shown in FIG. 1 is training device 102. Training device 102 includes a handle 104, flexible cord 106, and fan 108. Handle 104 provides a tubular element for engaging a user's hands. Handle 104 extends along a longitudinal axis such that it can accommodate both of a user's hands. Embodiments of handle 104 are the size of a standard golf club handle including putters, drivers, and irons. Handle 104 can be made of metal, carbon fiber, or aluminum alloy with a rubber or cushion like material encompassing the outside of the handle 104 such that a user's hands would directly contact the rubber or cushion like material. Embodiments of handle 104 are closed at one end and open at the other end. The open end of handle 104 provides a passage to a hollow center or cavity within handle 104.

Handle 104 includes extension tube 110 and lock mechanism 112. Extension tube 110 is moveably attached to handle 104 through its open end. Extension tube 110 is operable to moveably slide at least a portion of the length of the extension tube into and out of the cavity within handle 104 thereby providing a ridged extension of handle 104. Embodiments of extension tube 110 has a longitudinal axis that has a length between approximately 9 inches to 11 inches. The combined length of handle 104 and extension tube 110 is between approximately 21 inches. Extension tube 110 is made out of metal, carbon fiber or aluminum alloy.

Lock mechanism 112 is moveably attached to handle 104 and extension tube 110. Lock mechanism provides a means to allow extension tube 110 to moveably slide relative to handle 104 to any of a multitude of extended positions or an unextended (or refracted) position. Lock mechanism 112 thus provides a means to lock or prevent movement of extension tube 110 at a particular position relative to handle 104. Embodiments of lock mechanism 112 include twist locking means, clamping locking means and clasping locking means. Lock mechanism 112 as depicted in FIG. 1 illustrates a twist locking mechanism which allows extension tube 110 to move relative to handle 104 when lock mechanism 112 is twisted or turned in one direction (e.g., clockwise or counter-clockwise) and then locks or prevents extension tube 110 from moving relative to handle 104 when twisted or turned in the other direction. Embodiments of lock mechanism 112 provide a means to selectively allow and prevent movement of extension tube 110 relative to handle 104.

Flexible cord 106 is removeably attached to extension tube 110 at one end of flexible cord 106. Flexible cord 106 is fixedly attached at another end to fan 108. Yet, embodiments of flexible cord 106 can be removeably attached to fan 108 as well as fixedly attached to extension tube 110. In one embodiment, flexible cord 106 can be removeably attached from extension tube 110 by clamping, clasping, or screwing. Flexible cord 106 is made of a nylon cord. However, it should be appreciated that embodiments of flexible cord 106 can be made of any flexible material such as polyester, polypropylene, rubber, and plastics. Flexible cord 106 can extend along the longitudinal axis of training device 102 that has a length between approximately 9 inches to 10 inches. Training Device 102 is meant to have a weight that resembles the weight of a golf club, driver, putter, or iron.

Fan 108 is attached to flexible cord 106. Fan 108 has narrow portion 114 that can be fixedly attached to flexible cord 106. Fan 108 expands from the narrow portion 114 to a wide portion 116. Fan 108 provides a flexible piece of fabric (e.g., nylon, cotton, polyester, rubber, and plastics) that provides a resistance (through wind resistance) to the user when swinging training device 102. Fan 108 is adjustable to at least two different configurations. In one configuration, fan 108 can be in an open configuration (as shown in FIG. 1) wherein wind resistance felt by a user during use is maximized. In this configuration, fan 108 is open to have the largest surface area possible to resist a flow of air or wind. In a second configuration, fan 108 can be in a closed or collapsed configuration (shown in FIG. 3) such that fan 108 has a reduced surface area and the resistance felt by a user during use is reduced. Fan 108 can be maintained in the collapsed configuration through the use of straps, ties, clasps, or clamps such that fan 108 is maintained in the collapsed configuration during swinging of training device 102. One such exemplary retaining strap 118 for maintaining fan 108 in the collapsed position is shown in FIG. 2.

Fan 108 as shown in FIG. 1 is made of a single piece of fabric. However, it should be appreciated that embodiments of fan 108 include two or more pieces of fabric that are all connected to flexible cord 106 or connected through each other to the flexible cord 106. It is also contemplated, the collapsible form can include two or more connected or individual collapsible forms.

Figure 2:
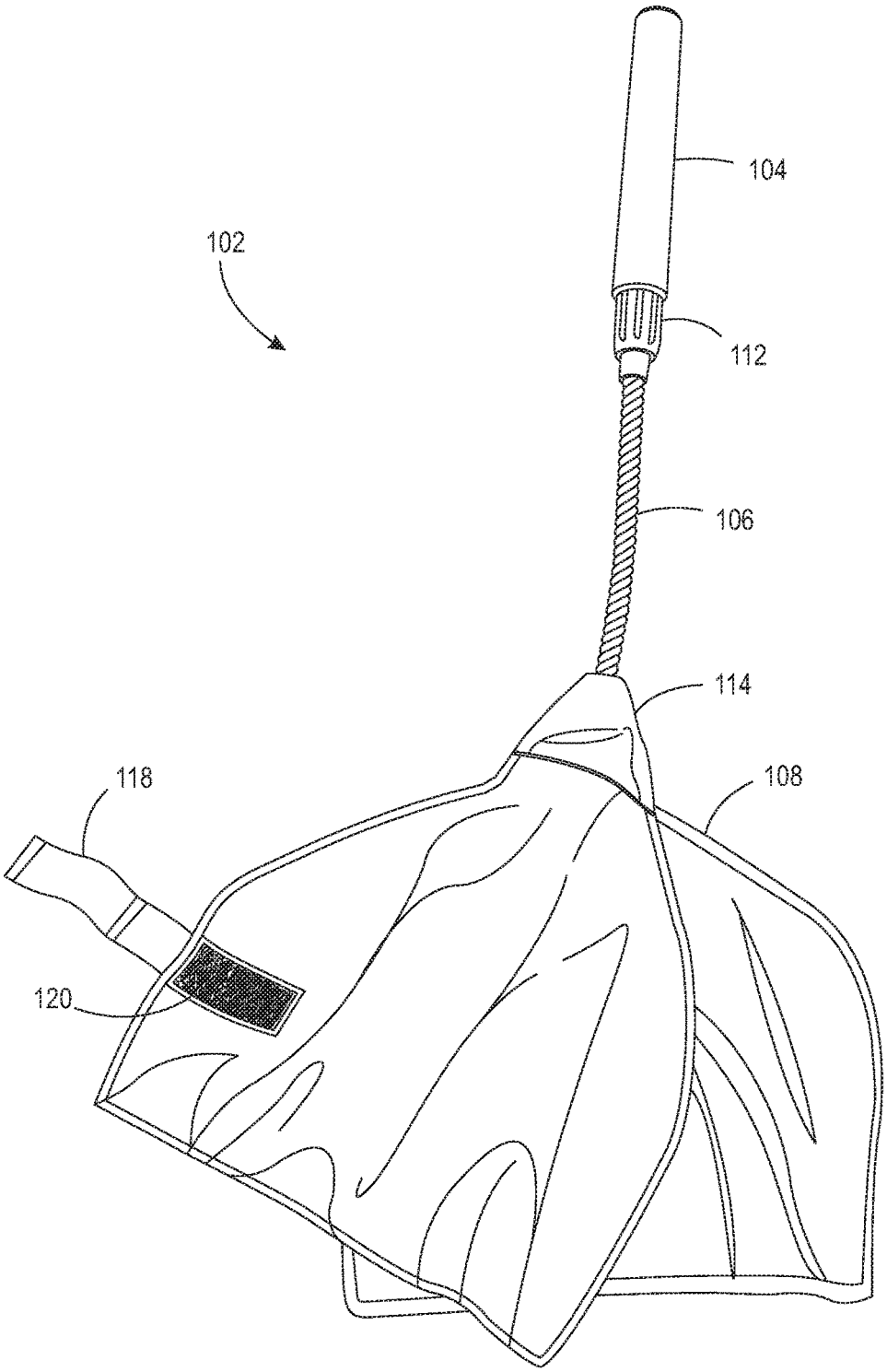
FIG. 2 is a perspective view of an exemplary device suitable for use in practicing exemplary embodiments of this disclosure.

Referring to FIG. 2, shown is a perspective view of an exemplary device suitable for use in practicing exemplary embodiments of this disclosure. Shown in FIG. 2 is training device 102 with handle 104, flexible cord 106, fan 108, lock mechanism 112, and retaining strap 118. As shown in FIG.

2, extension tube 110 cannot be seen because extension tube 110 is in an unextended position such that the entire length of extension tube 110 is located within the cavity of handle 104.

In the configuration shown in FIG. 2, lock mechanism 112 maintains extension tube 110 in the unextended position such that extension tube 110 does not move during use of training device 102. In other words, lock mechanism 112 is operable to maintain a position of extension tube 110 relative to handle 104 when training device 102 is swung. However, lock mechanism 112 can be manipulated to allow movement of extension tube 110 relative to handle 104 if desired by the user.

Also shown in FIG. 2 is fan 108 with retaining strap 118. In the embodiment shown in FIG. 2, fan 108 includes two pieces of fabric that are coupled to each other near the narrow portion 114 of fan 108. Embodiments of fan 108 provide for fan 108 to include one or more pieces of fabric that can be connected to one another near narrow portion 114 of fan 108. Embodiments of fan 108 include two or more pieces of fabric that can be connected to one another at any place to provide varying degrees of wind resistance when swung by a user.

Retaining strap 118 provides a means to maintain fan 108 in a collapsed position and allow fan 108 to freely expand. In the embodiment shown in FIG. 2, retaining strap 118 is a hook and loop fastener and has a longitudinal axis that is long enough such that when fan 108 is rolled or bunched together, retaining strap 118 can circumscribe fan 108. Retaining strap 118 can then be removeably attached to the portion of the hook and loop fastener that is on the surface of fan 108 shown at reference character 120.

It should also be appreciated that embodiments of fan 108 include other means of maintaining fan 108 in a collapsed position that do not require retaining strap 118. For example, embodiments of fan 108 can include hook and loop fasteners, clamps or clasps that are located on opposite sides of fan 108 or on opposite surfaces of fan 108 such that fan 108 can be rolled or bunched and can be selectively maintained in that position.

In one configuration, fan 108 expands as the velocity of the fan increases. Thus, as the swing speed increases, the relative cross sectional area of fan 108 increases thereby further increasing resistance.

Figure 3:
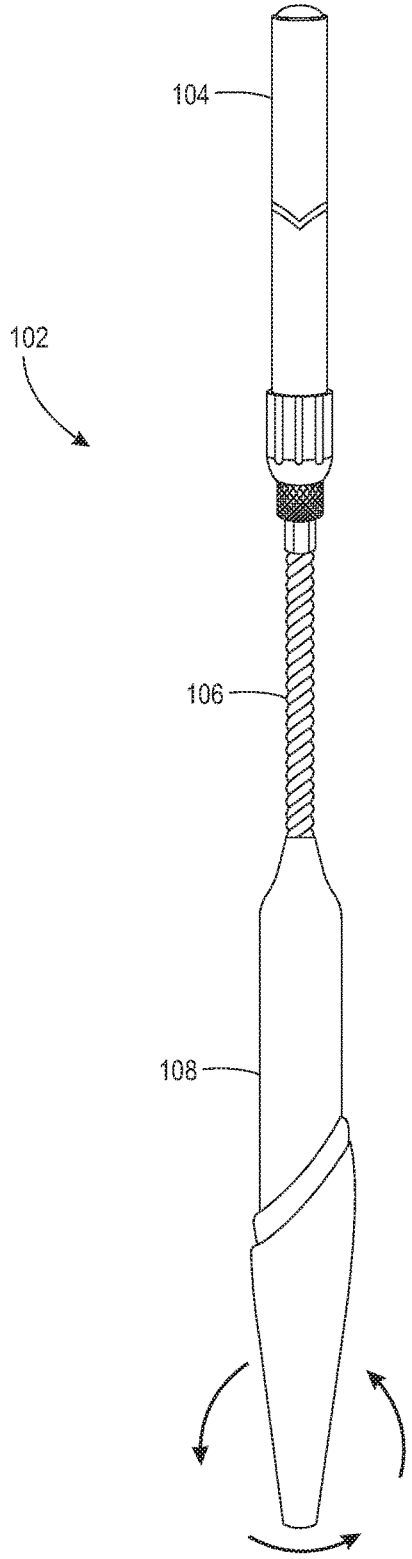
FIG. 3 is a front view of an exemplary device in an alternative configuration suitable for use in practicing exemplary embodiments of this disclosure.

Reference is now made to FIG. 3, which depicts a front view of an exemplary device in an alternative configuration suitable for use in practicing exemplary embodiments of this disclosure. Shown in FIG. 3 is training device 102 with handle 104, flexible cord 106, fan 108 and lock mechanism 112. Fan 108 as shown in FIG. 3 is in a collapsed position. The surface area of fan 108 that is open to the surrounding air is reduced in the collapsed position. In the embodiment shown in FIG. 3, fan 108 has been rolled into the collapsed position and is maintained in this position by retaining strap 118 (not shown).

Figure 4:
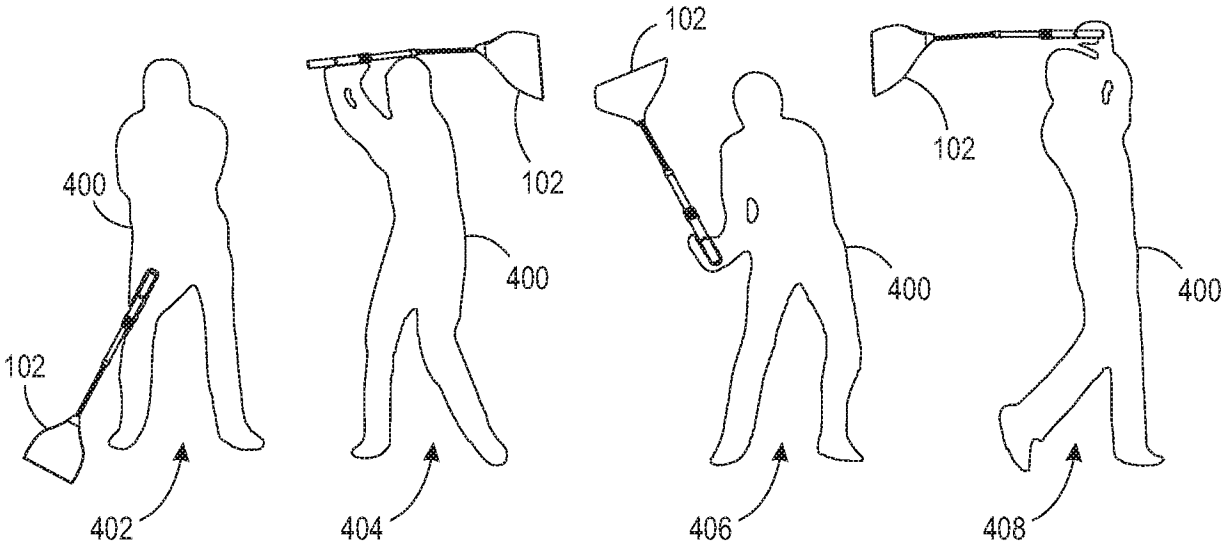
FIG. 4 is a flow diagram showing use of an exemplary device.

Referring to FIG. 4, shown is a flow diagram illustrating use of training device 102. Depicted in FIG. 4 is training device 102 and user 400 in four different configurations (402, 404, 406, and 408), which illustrate an exemplary swinging or training motion for a user that is using training device 102. Beginning at configuration 402, user 400 is holding training device 102 with both hands at handle 104 having fan 108 pointed toward the user's feet. Proceeding to configuration 404, user 400 will raise training device 102 such that they are preparing to swing training device 102 in a golf swinging like motion. Then at configuration 406, user 400 begins to swing training device 102 towards the ground as if the user were attempting to hit a golf ball or other object on the ground. Finally, at configuration 408, user 400 will finish the swinging motion by raising training device 102 as if user 400 were finishing a golf swing.

As shown in FIG. 4, fan 108 of training device 102 is in the expanded position such that wind or air resistance by fan 108 during use is maximized. Thus, user 400 is required to exert a larger force to complete the swinging motion of training device 102. It should be appreciated that training device 102 can be used in a similar fashion to that shown in FIG. 4 for the case that fan 108 is in the collapsed position.

Figure 5:
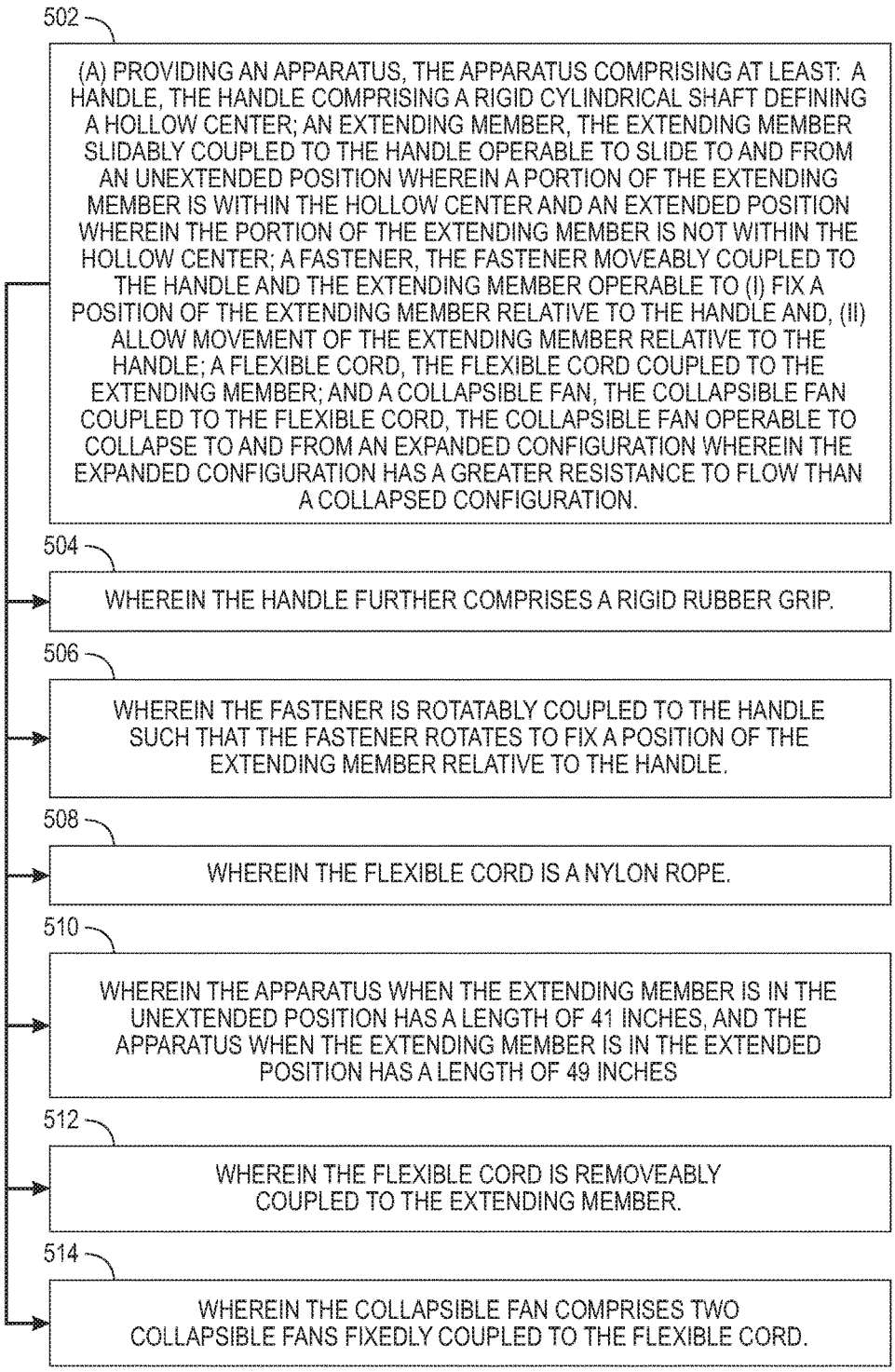
FIG. 5 is a logic flow diagram in accordance with a method and apparatus for performing exemplary embodiments of this disclosure.

Referring to FIG. 5, presented is an exemplary logic flow diagram in accordance with a method and apparatus for performing exemplary embodiments of this disclosure. Block 502 presents (a) providing an apparatus, the apparatus comprising at least: a handle, the handle comprising a rigid cylindrical shaft defining a hollow center; an extending member, the extending member slidably coupled to the handle operable to slide to and from an unextended position wherein the extending member is within the hollow center and an extended position wherein the extending member is not within the hollow center; a fastener, the fastener moveably coupled to the handle and the extending member operable to fix a position of the extending member relative to the handle and allow movement of the extending member relative to the handle; a flexible cord, the flexible cord coupled to the extending member; and a collapsible fan, the collapsible fan coupled to the flexible cord, the collapsible fan operable collapse to and from an expanded position wherein the collapsible fan is operable to resist a flow and a collapsed position wherein the collapsible fan is operable to not resist a flow. Then block 504 specifies wherein the handle further comprises a rigid rubber grip.

Some of the non-limiting implementations detailed above are also summarized at FIG. 5 following block 504. Block 506 relates to wherein the fastener is rotatably coupled to the handle such that the fastener rotates to fix a position of the extending member relative to the handle. Block 508 states wherein the flexible cord is a nylon rope. Then block 510 states wherein the apparatus when the extending member is in the unextended position has a length of 40 inches, and the apparatus when the extending member is in the extended position has a length of 49 inches. Block 512 relates to wherein the flexible cord is removeably coupled to the extending member. Then block 514 states wherein the collapsible fan comprises two collapsible fans fixedly coupled to the flexible cord.

Figure 6:
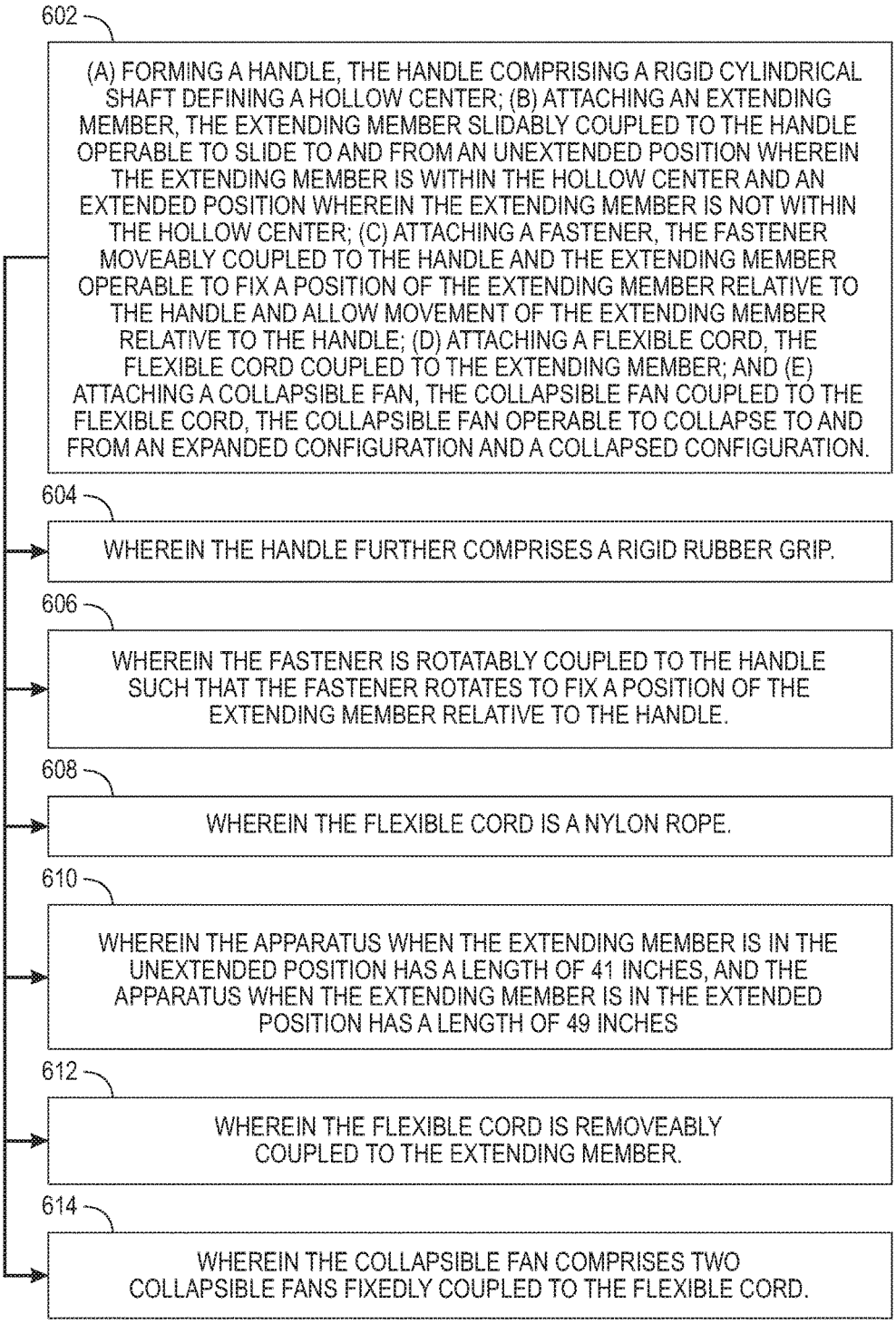
FIG. 6 is a logic flow diagram in accordance with a method and apparatus for performing exemplary embodiments of this disclosure.

Reference is now made to FIG. 6, which presents another exemplary logic flow diagram in accordance with a method and apparatus for performing exemplary embodiments of this disclosure. Block 602 presents (a) forming a handle, the handle comprising a rigid cylindrical shaft defining a hollow center; (b) attaching an extending member, the extending member slidably coupled to the handle operable to slide to and from an unextended position wherein the extending member is within the hollow center and an extended position wherein the extending member is not within the hollow center; (c) attaching a fastener, the fastener moveably coupled to the handle and the extending member operable to fix a position of the extending member relative to the handle and allow movement of the extending member relative to the handle; (d) attaching a flexible cord, the flexible cord coupled to the extending member; and (e) attaching a collapsible fan, the collapsible fan coupled to the flexible cord, the collapsible fan operable collapse to and from an expanded position wherein the collapsible fan is operable to resist a flow and a collapsed position wherein the collapsible fan is operable to not resist a flow. Block 604 relates to wherein the handle further comprises a rigid rubber grip.

Then Block 606 states wherein the fastener is rotatably coupled to the handle such that the fastener rotates to fix a position of the extending member relative to the handle. Block 608 specifies wherein the flexible cord is a nylon rope. Block 610 indicates wherein the apparatus when the extending member is in the unextended position has a length of 41 inches, and the apparatus when the extending member is in the extended position has a length of 49 inches. Block 612 then relates to wherein the flexible cord is removeably coupled to the extending member. Finally, block 614 states wherein the collapsible fan comprises two collapsible fans fixedly coupled to the flexible cord.

The logic diagram of FIG. 5 and FIG. 6 may be considered to illustrate the operation of a method. The logic flow diagram of FIG. 5 and FIG. 6 may also be considered a specific manner in which components of the device are configured to cause that device to operate, whether such a device is a golf training device or one of more components thereof.

It is to be understood that any feature described in relation to any one embodiment may be used alone, or in combination with other features described, and may also be used alone, or in combination with one or more features of any other of the embodiments, or any combination of any other of the embodiments. The presently disclosed embodiments are therefore considered in all respects to be illustrative and not restrictive. Furthermore, equivalents and modifications not described above may also be employed without departing from the scope of this disclosure, which is defined in the accompanying claims.

The invention claimed is:

1. An apparatus for training a user, the apparatus comprising:

(a) a handle, the handle comprising a rigid cylindrical shaft defining a hollow center;

(b) an extending member, the extending member slidably coupled to the handle operable to repeatedly slide to and from (i) an unextended position wherein a portion of the extending member is within the hollow center and (ii) an extended position wherein the portion of the extending member is not within the hollow center;

(c) a fastener, the fastener moveably coupled to the handle and the extending member operable to selectively fix a position of the extending member relative to the handle;

(d) a flexible cord, the flexible cord coupled to the extending member; and (e) a collapsible fan coupled to the flexible cord, the collapsible fan including a sheet having a first major surface, an opposing second major surface and a peripheral edge, the sheet having a cross-sectional area that creates a wind resistance, the collapsible fan being moveable between a collapsed configuration and an expanded configuration to change the amount of wind resistance experienced by the user, the cross-sectional area of the collapsed configuration of the collapsible fan being less than the cross-sectional area of the expanded configuration of the collapsible fan.

2. The apparatus according to claim 1, wherein the handle further comprises a rigid rubber grip.

3. The apparatus according to claim 1, wherein the handle is a golf club handle.

4. The apparatus according to claim 1, wherein the fastener is rotatably coupled to the handle such that the fastener rotates to fix a position of the extending member relative to the handle.

5. The apparatus according to claim 1, further comprising a retaining strap attached to the collapsible fan for maintaining the collapsible fan in the collapsed configuration.

6. The apparatus according to claim 1, wherein the handle and the extending member are in the unextended position have a length of 41 inches, and the handle and the extending member when the extending member are in the extended position have a length of 49 inches.

7. The apparatus according to claim 1, wherein the flexible cord is removeably coupled to the extending member.

8. The apparatus according to claim 1, wherein the collapsible fan comprises two collapsible fans fixedly coupled to the flexible cord.

9. A method of providing an apparatus to a user, the method comprising:

(a) providing the apparatus, the apparatus comprising:

a handle, the handle comprising a rigid cylindrical shaft defining a hollow center;

an extending member, the extending member slidably coupled to the handle operable to slide to and from (i) an unextended position wherein a portion of the extending member is within the hollow center and (ii) an extended position wherein the portion of the extending member is not within the hollow center;

a fastener, the fastener moveably coupled to the handle and the extending member operable to (i) fix a position of the extending member relative to the handle and, (ii) allow movement of the extending member relative to the handle;

a flexible cord, the flexible cord coupled to the extending member; and a collapsible fan that adjusts the amount of wind resistance experienced by the user, the collapsible fan being coupled to the flexible cord and having a cross-sectional area that creates wind resistance, the collapsible fan being operable between a collapsed configuration and an expanded configuration wherein the expanded configuration has a greater wind resistance than the collapsed configuration, wherein the cross-sectional area of the collapsed configuration of the collapsible fan is less than the cross-sectional area of the expanded configuration of the collapsible fan.

10. The method according to claim 9, wherein the handle further comprises a rigid rubber grip.

11. The method according to claim 9, wherein the fastener is rotatably coupled to the handle such that the fastener rotates to fix a position of the extending member relative to the handle.

12. The method according to claim 9, further comprising a retaining strap attached to the collapsible fan for maintaining the collapsible fan in the collapsed configuration.

13. The method according to claim 9, wherein the when the extending member is in the unextended position has a length of 41 inches, and the handle and the extending member are in the extended position has a length of 49 inches.

14. The method according to claim 9, wherein the flexible cord is removeably coupled to the extending member.

15. The method according to claim 9, wherein the collapsible fan comprises two collapsible fans coupled to the flexible cord.

16. A method of manufacture, the method comprising:

(a) forming a handle, the handle comprising a rigid cylindrical shaft defining a hollow center;

(b) attaching an extending member, the extending member slidably coupled to the handle operable to slide to and from an unextended position wherein the extending member is within the hollow center and an extended position wherein the extending member is not within the hollow center;

(c) attaching a fastener, the fastener moveably coupled to the handle and the extending member operable to fix a position of the extending member relative to the handle and allow movement of the extending member relative to the handle;

(d) attaching a flexible cord, the flexible cord coupled to the extending member; and (e) attaching a collapsible fan that adjusts an amount of wind resistance experienced by a user, the collapsible fan being a contiguous sheet having a cross-sectional area that creates the wind resistance and being coupled to the flexible cord, the collapsible fan being operable between a collapsed configuration and an expanded configuration, the cross-sectional area of the collapsed configuration of the collapsible fan being less than the cross-sectional area of the expanded configuration of the collapsible fan.

17. The method according to claim 16, further comprising attaching a retaining strap to the collapsible fan, the retaining strap sized to maintain the collapsible fan in the collapsed configuration.

18. The method according to claim 16, wherein the attaching of the fastener includes rotatably coupling the fastener to the handle such that the fastener rotates to fix a position of the extending member relative to the handle.

19. The method according to claim 16, wherein the attaching of the flexible cord includes attaching a rope.

20. The method according to claim 16, wherein the forming of the handle and the attaching of the extending member are in the unextended position having a length of 41 inches and in the extended position having a length of 49 inches.

21. The method according to claim 16, wherein the attaching of the flexible cord includes removeably coupling the flexible cord to the extending member.

22. The method according to claim 16, wherein the attaching of the collapsible fan comprises attaching two collapsible fans being fixedly coupled to the flexible cord.

23. An apparatus for training a user, the apparatus comprising:

(a) a grip configured for engaging a user hand;

(b) a flexible cord coupled to the grip and extending from the grip a substantially fixed length; and (c) a collapsible fan connected to the flexible cord, the collapsible fan including a sheet, the sheet being moveable between a collapsed position and an expanded position, wherein the expanded position of the collapsible fan has a cross sectional area that is greater than the cross sectional area of the collapsible fan in the collapsed position, the expanded position of the collapsible fan providing a greater resistance to movement of the collapsible fan than the collapsed position of the collapsible fan.

24. The apparatus of claim 23, further comprising a grip extension movably connected to the grip between a retracted position and an extended position.

25. The apparatus of claim 24, wherein the flexible cord is connected to the grip extension.

26. The apparatus of claim 24, further comprising a fastener coupled to the grip and the grip extension to selectively fix a position of the grip extension relative to the grip and allow movement of the grip extension relative to the grip.

27. The apparatus of claim 24, wherein the grip includes a hollow portion and the grip extension is partly disposed within the hollow portion.

28. The apparatus of claim 23, wherein the flexible cord is substantially inextensible.

29. The apparatus of claim 23, further comprising a retaining strap attached to the collapsible fan for maintaining the collapsible fan in the collapsed position.

30. The apparatus of claim 23, wherein the grip is rigid.

31. An apparatus for training, the apparatus comprising:

(a) a grip configured for engaging a user hand;

(b) a grip extension movably coupled to the grip between a retracted position and an extended position;

(c) a flexible shaft coupled to at least one of the grip and the grip extension and extending a substantially fixed length; and (d) a collapsible fan connected to the flexible shaft, the collapsible fan including a sheet that changes an amount of wind resistance experienced by the user hand, the collapsible fan being a contiguous sheet having a cross-sectional area that creates the wind resistance and the collapsible fan being moveable between a collapsed position and an expanded position, wherein the expanded position of the collapsible fan provides a greater wind resistance than the collapsed position of the collapsible fan, the cross-sectional area of the collapsible fan in the collapsed position being less than the cross-sectional area of the of the collapsible fan in the expanded position.

* * * * *